United States Patent [19]

Talento

[11] Patent Number: 4,687,515

[45] Date of Patent: Aug. 18, 1987

[54] VACUUM INTERRUPTER CONTACT

[75] Inventor: Joseph L. Talento, Media, Pa.

[73] Assignee: General Electric Company, New York, N.Y.

[21] Appl. No.: 849,995

[22] Filed: Apr. 10, 1986

[51] Int. Cl.[4] ..... B22F 1/00

[52] U.S. Cl. ..... 75/246; 75/247; 200/265; 200/266; 252/513; 419/23; 419/30; 419/32; 419/38; 419/60

[58] Field of Search ..... 419/30, 32, 60, 38, 419/23; 252/513; 75/246, 247; 200/265, 266

[56] References Cited

U.S. PATENT DOCUMENTS

| | | | |
|---|---|---|---|
| 3,821,505 | 6/1974 | Wood | 200/144 B |
| 3,859,087 | 1/1975 | Backstrom | 419/23 |
| 3,998,632 | 12/1976 | Kosteruk et al. | 75/245 |
| 4,008,081 | 2/1977 | Hundstad | 420/501 |
| 4,032,301 | 6/1977 | Hassler et al. | 428/567 |
| 4,067,379 | 1/1978 | Hassler et al. | 164/69 |
| 4,183,746 | 1/1980 | Pearce et al. | 75/234 |
| 4,190,753 | 2/1980 | Gainer | 200/144 B |
| 4,197,218 | 4/1980 | McKaveney | 252/503 |
| 4,230,491 | 10/1980 | Behnke | 75/244 |
| 4,325,734 | 4/1982 | Burrage et al. | 419/60 |
| 4,390,458 | 6/1983 | McKaveney | 252/503 |
| 4,419,551 | 12/1983 | Kato | 200/144 B |
| 4,554,425 | 11/1985 | Kashiwagi et al. | 200/144 B |
| 4,594,218 | 6/1986 | Dubots et al. | 419/4 |

FOREIGN PATENT DOCUMENTS 1550640 8/1979 United Kingdom .

*Primary Examiner*—Stephen J. Lechert, Jr.
*Attorney, Agent, or Firm*—Walter C. Bernkopf; Richard A. Menelly; Fred Jacob

[57] ABSTRACT

An electrical contact for vacuum interrupters of a pressed and sintered composition of copper (60–80 wt %), ferrovanadium alloy (40–100 wt % of the balance) with at least 80 wt % of any remainder consisting of a refractory metal of the group of chromium, vanadium and their compounds. The ferrovanadium alloy comprises 55–85 wt % of vanadium.

5 Claims, 3 Drawing Figures

VACUUM INTERRUPTER CONTACT

BACKGROUND OF THE INVENTION

This invention relates to electrical contacts for vacuum interrupters including, specifically, contact materials useful for, but not limited to, medium voltage interrupters operating in the range of 4–38 kilovolts.

Vacuum interrupters must meet performance requirements whose attainment is substantially dependent on the characteristics of the interrupter contact materials. These requirements are diverse and require incompatible material properties so that no single contact material appears to ideally meet all requirements. Contact material selection and formulation is thus a compromise based on obtaining characteristics balanced to best meet the diverse functional requirements.

Functional requirements of vacuum interrupters include adequate (1) continuous current carrying capability, (2) transient characteristics, (3) voltage withstand, (4) short circuit current interruption ability, (5) anti-weld properties, and (6) contact erosion resistance.

The ability to continuously carry a sufficient current without excessive heat rise requires that the series resistance measured across the two abutting, i.e., closed, contacts be extremely low. Thus, electrode contacts must comprise a highly conductive material and further must have contact surfaces that continue to make a low resistance contact with the abutting electrode contact. Copper bismuth, for example, has excellent current carrying capabilities.

Transient characteristics, i.e., the phenomena occurring upon contact opening, includes the ability to withstand chopping. Chopping is an undesirable phenomena characterized by the immediate extinction of an arc produced upon contact opening. Immediate extinction of the arc, i.e., before "current zero" of the a.c. source, occurs primarily under conditions of low load current, e.g., 5–50 amps. Such chopping can result in transient overvoltages and reignition of the arc after "current zero". Chopping is reduced by contact materials that produce vapor emissions responsive to the arc to sustain the arc from the time of current interruption to current zero. For example, in copper bismuth contacts, bismuth emits vapors at relatively low arc temperature to sustain the arc until current zero.

The vacuum interrupter should also have adequate voltage withstand. This means that there should be no current conduction or arcing across open or even partially open contacts as a result of the voltages applied across the contacts. Such conduction or reignition should be avoided.

Interruption ability is the ability of the interrupter to open and to "clear a fault" under short circuit conditions. The interruption rating, i.e., the maximum current at which the interrupter can extinguish the arc and clear the fault, is adversely affected by the release and presence of excessive vapor emissions during heavy arcing. Certain contact materials that emit electrons or excessive gas vapors under severe arc conditions are thus undesirable.

Interrupter contacts also must have adequate antiweld properties to assure that contacts can be reopened when so commanded. Certain materials, such as pure copper, tend to weld or stick when closed onto a fault current. Contacts of such materials could fail to be opened or require excessive force to open. Contact materials containing bismuth, a non-refractory brittle material having a low melting temperature, provide excellent anti-weld characteristics.

A vast variety of contact materials has been disclosed for achieving various contact performance and processing requirements. Many include mixtures of a highly electrically and thermally conductive, non-refractive metal, such as copper, with a semi-refractory metal of low ductility. Refractory metals having a very high boiling point, such as tungsten, are considered to be undesirable for short circuit current interruption. This is based on the theory that the temperature of hot spots produced on the contact surface by arcing is below their boiling point temperature but is sufficiently high to emit free electrons. Such emission of electrons impedes arc quenching during fault current interruption and thus impairs interruption capability.

It has thus been proposed to mix copper with semi-refractive metal elements having melting and boiling temperatures of an intermediate range, such as chromium, cobalt, iron, nickel, titanium, vanadium and zirconium. Copper chromium has been cited as having suitable interruption and contact erosion characteristics and thus has been selected for practical application.

Such copper-chrome compositions have been prepared by an impregnation process. The semi-refractory metal element is pressed and sintered in vacuum or in a reducing atmosphere. The resulting matrix is then impregnated with a high conductivity material such as copper in vacuum such that the infiltrated metal is retained in essentially non-alloyed form. In such impregnated sintered compositions, it is difficult to obtain the high percentage of conducting material desired. Therefore, such compositions have instead been prepared by a press and sinter process. The copper and semi-refractive metal powders are admixed, cold-pressed and sintered in vacuum or a reducing atmosphere at temperatures below the melting point of constituents. Products of high density, e.g., in excess of 90%, can be obtained by repetitive cold-pressing and sintering or by hot densification. Despite their low porosity, such materials can still emit substantial gas when subjected to high temperatures. However, during contact operation, the gettering action of the semi-refractive metal, i.e., chromium, is believed to assist in arc quenching for the purpose of fault clearing. Efforts, e.g., particle size selection, have been directed to improving other characteristics of copper-chrome compositions, such as improving their tensile or anti-weld characteristics.

SUMMARY OF THE INVENTION

It is an object of this invention to provide an improved material for the contacts of vacuum interrupters.

It is a further object to provide sufficient particle hardness to provide desired voltage withstand and contact erosion resistance characteristics and reasonable anti-weld characteristics.

It is yet a further object to provide such a contact material that has sufficiently low vapor pressure at its melting temperature to provide adequate short circuit current interruption performance.

It is yet a further object to provide such a contact material that has sufficient electrical conductivity and also has hydrogen gettering capability to maintain a suitable vacuum in the contactor.

The invention provides a vacuum circuit interrupter having engagable and disengagable electrode contacts of pressed and sintered material of high density comprising copper in the range of 60–80 wt %, with the balance of the material comprising a comminuted alloy of ferrovanadium—in the range of 40–100 wt % of the balance—with at least 80% of any remainder of the balance constituting at least an additional semi-refractory metal, or at least an alloy thereof or combinations thereof. The ferrovanadium alloy comprises 55–85 wt % of vanadium. One embodiment comprises 75 wt % of copper with the balance comprising ferrovanadium. A preferred embodiment comprises about 75 wt % copper, 12.5 wt % ferrovanadium and 12.5 wt % chromium.

BRIEF DESCRIPTION OF THE DRAWINGS

For a better understanding of my invention, reference may be had to the following description taken in conjunction with the accompanying illustrations, wherein.

DESCRIPTION OF THE PREFERRED EMBODIMENT

Figure 1:
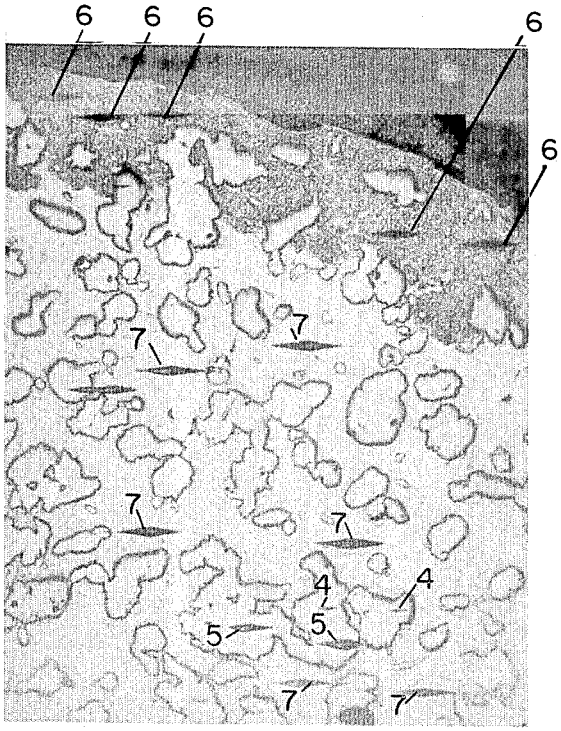
FIG. 1 is a photomicrograph at 100X magnification of the grain structure of a copper-ferrovanadium contact material comprising 75 Cu-12.5 $FeV_{(80)}$-12.5 Cr.

The contact material according to the invention comprises a pressed and sintered product of copper and of comminuted ferrovanadium alloy. Ferrovanadium alloy and its particles have characteristics differing substantially from those of its individual constituents.

Pure iron and vanadium are quite soft and ductile whereas the ferrovanadium as used in my contact material is very hard and brittle. Hardness ratings of iron and vanadium are, for example, found in the ASM Metals Handbook of the American Society for Metals, Volume 1, 8th Edition, on pages 1211 and 1227, respectively. Ingot iron is stated to have a specified hardness of 82 Brinell which corresponds to Knoop 106. Vanadium is stated to have a specified hardness of 85 Rockwell B which corresponds to Knoop 180. Based on my hardness test described below, the ferrovanadium material in the subject contact material, however, has a hardness of Knoop 1060 and thus is vastly harder than either of its constituents iron and vanadium.

The following table lists microhardness test data for a contact (a) made in accordance to the invention that comprises 75 wt % copper, 12.5 wt % ferrovanadium and 12.5 wt % chromium and, for comparison, a contact (b) made without ferrovanadium that comprises 75 wt % copper and 25 wt % chromium.

TABLE 1

MICROHARDNESS TESTS
100 GRAM LOAD - 10.25 OBJECTIVE

| | Filar | Knoop | Equivalent Rockwell |
|---|---|---|---|
| (a) 75% Cu—12.5% Cr—12.5% $FeV_{(80)}$ | | | |
| Cu Matrix | 255 | 106 | $R_B$ 55 |
| Melted Surface | 185 | 202 | $R_B$ 90 |
| Chromium Particles | 155 | 290 | $R_C$ 24 |
| $FeV_{(80)}$ Particles | 80 | 1060 | $R_C$ 65+ |
| (b) 75% Cu—25% Cr | | | |
| Cu Matrix | 285 | 82 | $R_B$ 35 |
| Melted Surface | 195 | 180 | $R_B$ 85 |
| Chromium Particles | 155 | 290 | $R_C$ 24 |

The expression "melted surface" refers to the melting of the contact constituents adjacent to the contact surface of the contacts. This results from the very high temperatures produced at the contact surface during operation of the interrupter and primarily by the arcing that results upon interruption.

The above tabular data shows the ferrovanadium, i.e., $FeV_{(80)}$, particles in my Cu-FeV-Cr composition to be substantially harder than the chromium particles. It further indicates that the copper matrix and melted surface of my Cu-FeV-Cr contact are harder than the corresponding copper matrix and melted surface of the Cu-Cr contact.

The harder, more brittle nature of the ferrovanadium and of the melted surface of my ferrovanadium containing contacts is expected to provide improved anti-weld properties and voltage withstand, transient and interrupting characteristics.

Additional advantages should be realized. At the high melting temperatures produced at the contact surface during interruption, vanadium and iron have lower vapor pressures than chromium. Thus, the undesirable vapor generated during interrupter arcing by my ferrovanadium contact should be less than that produced by Cu-Cr contacts. Also, the vanadium that is vaporized and deposited on the metallic surfaces of the interrupter is believed to provide improved gettering of hydrogen.

Contacts made of pressed and sintered 75 wt % copper, 12.5 wt % ferrovanadium and 12.5 wt % chromium were installed in vacuum interrupters that were electrically tested by being repetitively closed and opened. At least one contact was removed from the interrupter and sliced orthogonally to the contact surface. Microhardness tests, utilizing a "Tukon" hardness tester, made on this sliced surface provided the above tabulated hardness for the above recited contact constituents and for the melted surface. For comparison purposes, samples of 75 wt % copper and of 25 wt % chromium were similarly prepared and tested for their hardness.

Figure 3:
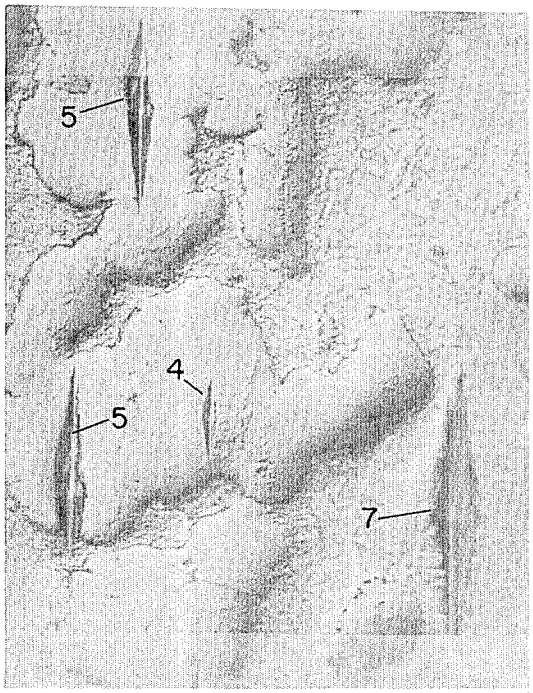
FIG. 3 is a photomicrograph of the same material depicted in FIGS. 1 and 2 but at a magnification of 400X.
Figure 2:
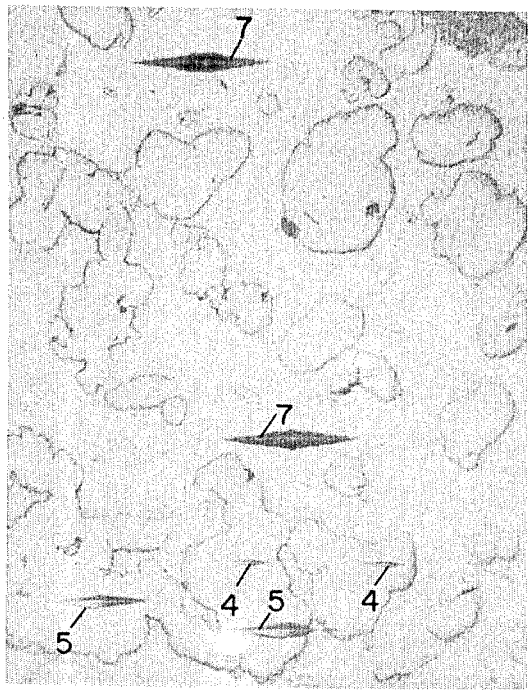
FIG. 2 is a photomicrograph at 200X magnification of the above described contact material.

FIGS. 1, 2 and 3 are photomicrographs taken of the sliced surface of my Cu-FeV-Cr contact subsequent to the completion of hardness tests. These figures illustrate the copper matrix, the chromium particles and the ferrovanadium particles. FIG. 1 additionally illustrates the melted surface, i.e., the contact surface, of the contact. The "Tukon" microhardness tests produce diagonal indentations on the sample. The length of these indentations is inversely related to the hardness of the constituents and was utilized to derive the above tabulated hardness numbers. Diagonal indentations on the various constituent types are labeled in the illustrations, respectively, as 4 for the indentations on the ferrovanadium, 5 for the indentations on the chromium particles, 6 (of FIG. 1) for the indentations on the melted surface and 7 for the indentations on the copper matrix. The indentations 4 on the ferrovanadium particles are of substantially the shortest length. The length of the indentations for the other materials increases, respectively, in the following order: chromium, melted surface and copper matrix. Multiple indentations were made and are illustrated and identified for each type of constituent. Areas or islands of any constituent type can thus be identified by the indentations produced on their surface.

Embodiments of the inventive composition were made with commercially available ferrovanadium comprising 80 wt % vanadium. The ferrovanadium alloy was ground and sieved utilizing 325 mesh and 200 mesh screens to derive particles between 45 to 73 microns.

In one embodiment, the ferrovanadium powders were mixed with high purity 99.7 wt % copper particles, having an average particle size of 12 microns, in the ratio of 25 wt % of ferrovanadium and 75 wt % of copper. The resulting mixture was blended and cold-pressed at 50 tons/in$^2$. These were then vacuum sintered for two (2) hours at a temperature of 1030° C., i.e., slightly below the melting temperature of copper and substantially below the melting point of the ferrovanadium constituents. The sintered buttons were repressed at 50 tons/in$^2$ and vacuum resintered for two (2) hours at a temperature of 1030° C. to provide a product of over 90% of theoretical density. A second embodiment was made of a mixture of 75 wt % copper, 12.5 wt % ferrovanadium and 12.5 wt % chromium. This utilized electrolytic 99% chromium of a particle size smaller than 75 microns. Particles of the other constituents were as described with respect to the first embodiment and it was similarly processed. This mixture had a repressed and resintered density of over 90%. This composition displayed somewhat improved sintering characteristics.

It is believed that compositions of primary utility will utilize 60–80 wt % of copper, with ferrovanadiun comprising 40–100% of the balance and with the ferrovanadiun comprising 55–85 wt % of vanadium.

Various processing modifications might be made. For example, volatile lubricants may be added to the powders to improve powder flow and pressing characteristics if die pressing is utilized. Alternatively, isostatic pressing may be utilized. Sintering might be done in a reducing atmosphere of hydrogen instead of in vacuum. Additionally, some minor additional constituents, such as minute amounts of anti-weld material, may be added to the composition.

Although the inventions have been described with reference to specific embodiments thereof, numerous modifications thereof are possible without departing from the inventions, and it is desirable to cover all modifications falling within the spirit and scope of these inventions.

Having described my invention, what I claim as new and desire to secure by Letters Patent is:

1. A vacuum interrupter contact of material comprising:

(a) copper in the range of 60–80 wt % of the material;

(b) ferrovanadium alloy comprising 40–100 wt % of the balance of said material;

(c) at least 80% of any remainder of said balance consisting of a refractory metal of the group of chromium, vanadium and their compounds;

(d) said ferrovanadium alloy comprising 55–85 wt % of vanadium;

(e) said material being made by grinding said ferrovanadium alloy, admixing powders of said ferrovanadium alloy and of the other constituents, and pressing and sintering said powders to provide a material having a density of at least 90% of theoretical density.

2. The vacuum interrupter contact of claim 1 wherein said ferrovanadium alloy comprises about 80 wt % of vanadium.

3. The vacuum interrupter contact according to claim 1 or 2 wherein copper comprises about 75 wt % of the material and ferrovanadium comprises about 12.5 wt % of the material.

4. The vacuum interrupter contact according to claim 3 wherein the remainder of said balance comprises chromium.

5. The vacuum interrupter contact according to claims 1 or 2 wherein copper comprises about 75 wt % of the material and ferrovanadium comprises about 100 wt % of the balance.

* * * * *